United States Patent [19]

Denis et al.

[11] Patent Number: 4,998,480

[45] Date of Patent: Mar. 12, 1991

[54] PNEUMATIC UNLOCKING DEVICE FOR MUNITIONS RELEASABLE FROM A CARRIER

[75] Inventors: Jean F. Denis, Checy; Alain Lepicard, rue Royale; Henri Ropars, Place du Val, all of France

[73] Assignee: Thomson-Brandt Armements, Boulogne Billancourt, France

[21] Appl. No.: 461,681

[22] Filed: Jan. 8, 1990

[30] Foreign Application Priority Data

Jan. 17, 1989 [FR] France ..... 89 00483

[51] Int. Cl.[5] ..... F42B 13/50

[52] U.S. Cl. ..... 102/393; 89/1.51; 89/1.57

[58] Field of Search ..... 102/393, 378; 89/1.57, 89/1.51, 1.14

[56] References Cited

U.S. PATENT DOCUMENTS

| | | | |
|---|---|---|---|
| 2,447,941 | 8/1948 | Imber et al. | 102/393 |
| 2,972,946 | 2/1961 | Poulter | 102/393 |
| 3,902,400 | 9/1975 | Kincheloe et al. | 102/393 |
| 4,132,147 | 1/1979 | Contaldo | 89/1.58 |
| 4,455,943 | 6/1984 | Pinson | 102/489 |
| 4,480,552 | 11/1984 | Eckel et al. | 102/393 |
| 4,524,694 | 6/1985 | Boeder | 102/393 |
| 4,558,645 | 12/1985 | Boeder et al. | 102/393 |
| 4,688,486 | 8/1987 | Hall et al. | 102/393 |
| 4,879,941 | 11/1989 | Repé et al. | 89/1.14 |

FOREIGN PATENT DOCUMENTS

| | | |
|---|---|---|
| 169956 | 2/1986 | European Pat. Off. . |
| 297992 | 1/1989 | European Pat. Off. . |
| 1267296 | 6/1961 | France . |

*Primary Examiner*—David H. Brown

*Attorney, Agent, or Firm*—Oblon, Spivak, McClelland, Maier & Neustadt

[57] ABSTRACT

Disclosed is a device for unlocking a system for fixing sub-munitions on board a carrier, namely any flying vehicle (such as a rocket, missile, stand-off missile etc.). Each sub-munition is held on the body of the carrier by a movable holding clamp fixed to the sub-munition locked by a rod against which there lies a roller fixed to the end of the movable holding clamp. A pneumatic system formed by a piston activates the rod comprising different parts with different widths and diameters so that its step part, on which the roller lies, is translated and leaves place for its central part, in such a way that the movable holding clamp can pivot around the shaft, thus releasing the sub-munition.

4 Claims, 4 Drawing Sheets

PNEUMATIC UNLOCKING DEVICE FOR MUNITIONS RELEASABLE FROM A CARRIER

BACKGROUND OF THE INVENTION

The present invention concerns a device for unlocking a system for fixing sub-munitions on board a carrier, namely any flying vehicle (such as a rocket, a missile, a stand-off missile, etc.). The ejection of each of the sub-munitions fixed to the body of the carrier is done simultaneously upon command, by means of the unlocking of the fixing system.

The function of these carriers consists of the transportation, up to the vicinity of the target or targets, of sensitive sub-munitions, namely sub-munitions which could be damaged by stresses, for example mechanical stresses. This function further consists in releasing these sub-munitions by their simultaneous ejection in order to increase the probability of destruction of the target or targets.

The fixing of the sensitive sub-munitions, provided with external or internal supports, to the carrier is done by a holding system consisting, firstly, of a fixing system comprising a movable holding clamp gripping the sub-munition by means of the supports and, secondly, of a locking system keeping the moving holding clamp against the support of the sub-munition before ejection.

To activate the unlocking of the system for locking the clamp against the support of the sub-munition, several methods are used: either a mechanical system with rods or a pyrotechnical system placed at each holding point. The use of these systems shows up several drawbacks:

- problems of bulk and weight;
- the reduction of the reliability of a system such as this due to any pyrotechnical incident;
- the changing of the reaction times;
- the complex nature of an electrical network to be installed.

An aim of the invention is to overcome the above-mentioned drawbacks in both locking systems by using a pneumatic unlocking system using the gases of a generator of a system for the ejection of the sub-munition.

SUMMARY OF THE INVENTION

An object of the invention is a device for the unlocking of a fixing system consisting of a movable holding clamp supporting a sub-munition against supports made on the sub-munition by means of a locking, system and holding sub-munitions on board a carrier, the fixing system being triggered prior to or simultaneously with the application of an ejection system, a device comprising a pneumatic system and means to send a part of the gases of a gas generator from the ejection system to the pneumatic system controlling the unlocking of the fixing system.

BRIEF DESCRIPTION OF THE DRAWINGS

Other features and advantages provided by the invention will appear, by way of example, in an embodiment in the following detailed description illustrated by the following figures of which.

DESCRIPTION OF A PREFERRED EMBODIMENT

Figure 1:
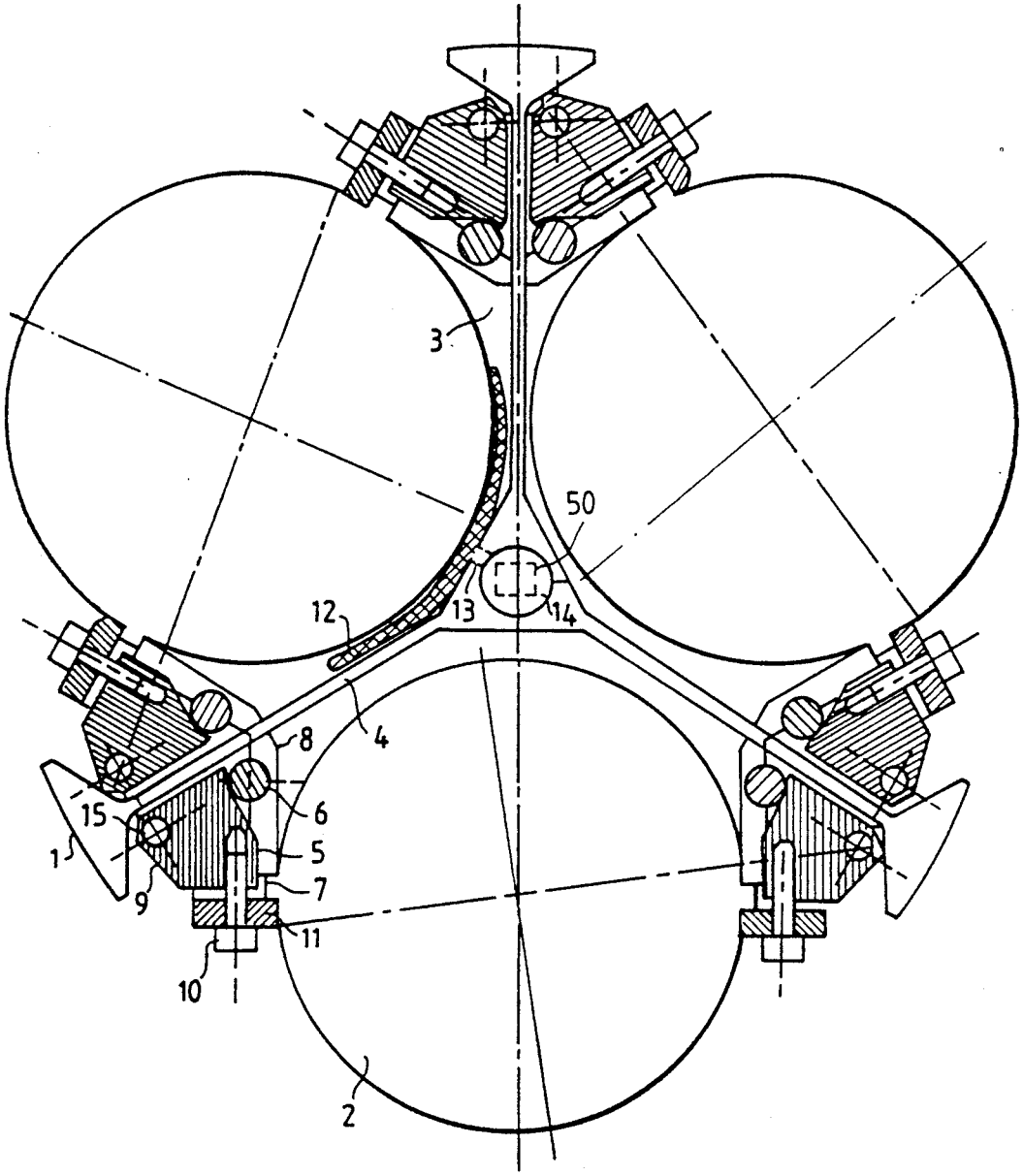
FIG. 1 PRIOR ART
FIG. 1 shows a cross-section of a body of a carrier transporting sub-munitions and fitted out with a device for the mechanical unlocking of the sub-munitions fixing system.

FIG. 1 shows a cross-section of a body of a carrier conveying sub-munitions and fitted out with a device for the mechanical unlocking of a sub-munitions fixing system. The body 1 having, for example, three compartments, is fitted out, for example, in each of these compartments 3 with means 5 that hold the sensitive sub-munition 2 to the body 1. These means are mechanical systems. These mechanical systems enable at least on support 7 of the sub-munition 2 to fulfil the role of blocking this sub-munition 2. Each sub-munition is fitted out, for example, with four supports 7, two of which are shown in FIG. 1. In the present example, these supports are positioned on the exterior of the sub-munition, but internal supports could be arranged inside the sub-munition.

The means 5 include a fixed part 8 connected to the edge 4 of the body 1 and a movable holding clamp 9 around a shaft 15, fixed to the fixed part 8 and connected to a mechanical locking system constituted by a rod 6. A screw 10 provided, for example, with a clamp 11 sets up a clamping force on the external supports 7. This operation is performed at the four locations where the means 5 are housed, and enables the sub-munition 2 to be held on the body 1. The unlocking of the locking system is done prior to or simultaneously with the application of an ejection system which has also been shown in this same figure. This system of ejection is identical in all the compartments 3 containing a sub-munition and has, for example, a bag 12 connected by a conduit 13 to a section 14 linked to a gas generator 50. When the gas generator 50 is triggered, the gases that have emerged therefrom come through the different apertures into the bag 12 which expands and exerts a thrust force against the sub-munition 2 which acts on the clamping means 5 after the unlocking of the mechanical locking system.

Figure 2:
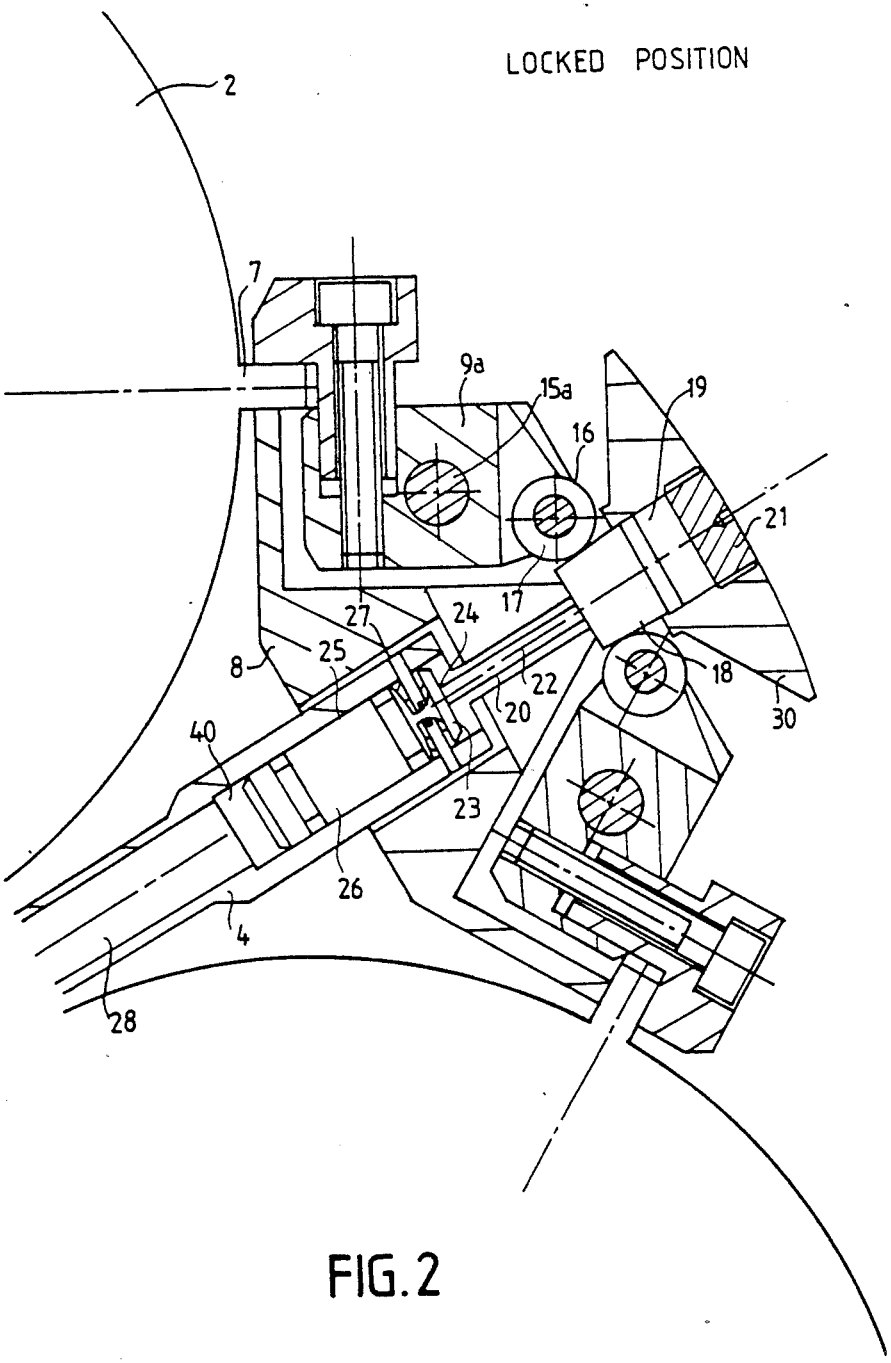
FIG. 2 shows a cross-section of a pneumatic unlocking device, according to the invention, for a sub-munitions fixing system in locked position.

FIG. 2 shows a cross-section of a pneumatic unlocking device, having a pneumatic system 40 according to the invention, for a sub-munitions fixing system in locked position. In this FIG. 2, only the end of the body 1 of the carrier where the pneumatic unlocking device is fixed is shown. In the locked position, the movable holding clamp **9*a* around the shaft 15*a* exerts a clamping force, for example, on the external supports 7 of the sub-munition 2. This force is due to the fact that, at the end 16 of the holding clamp 9*a*, a roller 17 is placed in a leaning position against a step part 18 of a rod 20. This step part 18 is lightly engaged in a cavity 19 made at the upper end 30 of the edge 4 and enables the rod 20 to be guided during a movement of this rod. The cavity 19 is bounded at one of its ends, for example by a closing cap 21, so as to enable a sufficient shift of the step part 18 within the cavity 19 to release the movable holding clamp 9*a* through the reduction of the structure of the rod 20. This rod 20 is, for example, formed by three parts: a step part 18, a central part 22 and a flat part 23 at its lower end 24. The dimension and size of this rod 20 have been determined so that, in the locked position, the diameter and width of the step part 18 prevent any movement of the movable holding clamp 9***a* and, in the unlocked position, the diameter and width of the central part 22 release this clamp 9*a*. The flat part 23 has, for example, a width enabling it to be inserted into a first conduit 25 having a piston 26 therein. The flat part 23 is positioned on the piston 26 with the upper part of the piston 26 being used as a stop for the flat part 23. The rod 20, guided in its movement by the cavity 19 receiving the end of the step part 18 of the rod 20 has its flat part 23 placed, for example, inside the first conduit 25, on the piston 26 held in a position that is locked, for example, by means of a shearing pin 27. This first conduit 25 is directly connected with a second conduit 28 for the inlet of the gases coming from a generator of the ejection system not shown in this FIG. 2. This pneumatic unlocking device provides for the simultaneous ejection of the sub-munitions on board the body 1 of the carrier. For, in mechanical unlocking systems using rods, each movable holding clamp 9*a* was locked by a mechanical system which was disadvantageous for a simultaneous release of the different sub-munitions due to the different reaction times of the controls coming towards the mechanical systems. In the context of our invention, each pneumatic unlocking device releases two fixing systems, namely two movable holding clamps 9*a* under the effect of a rod 20 capable of translating by means of the gases of a generator of the ejection system actuating a piston 26 and going from a locked position to an unlocked position. This system enables a reduction in the number of unlocking devices since, in one and the same embodiment, with the same number of supports fixed to each munition, only six devices are used instead of twelve for a mechanical device.

Figure 3:
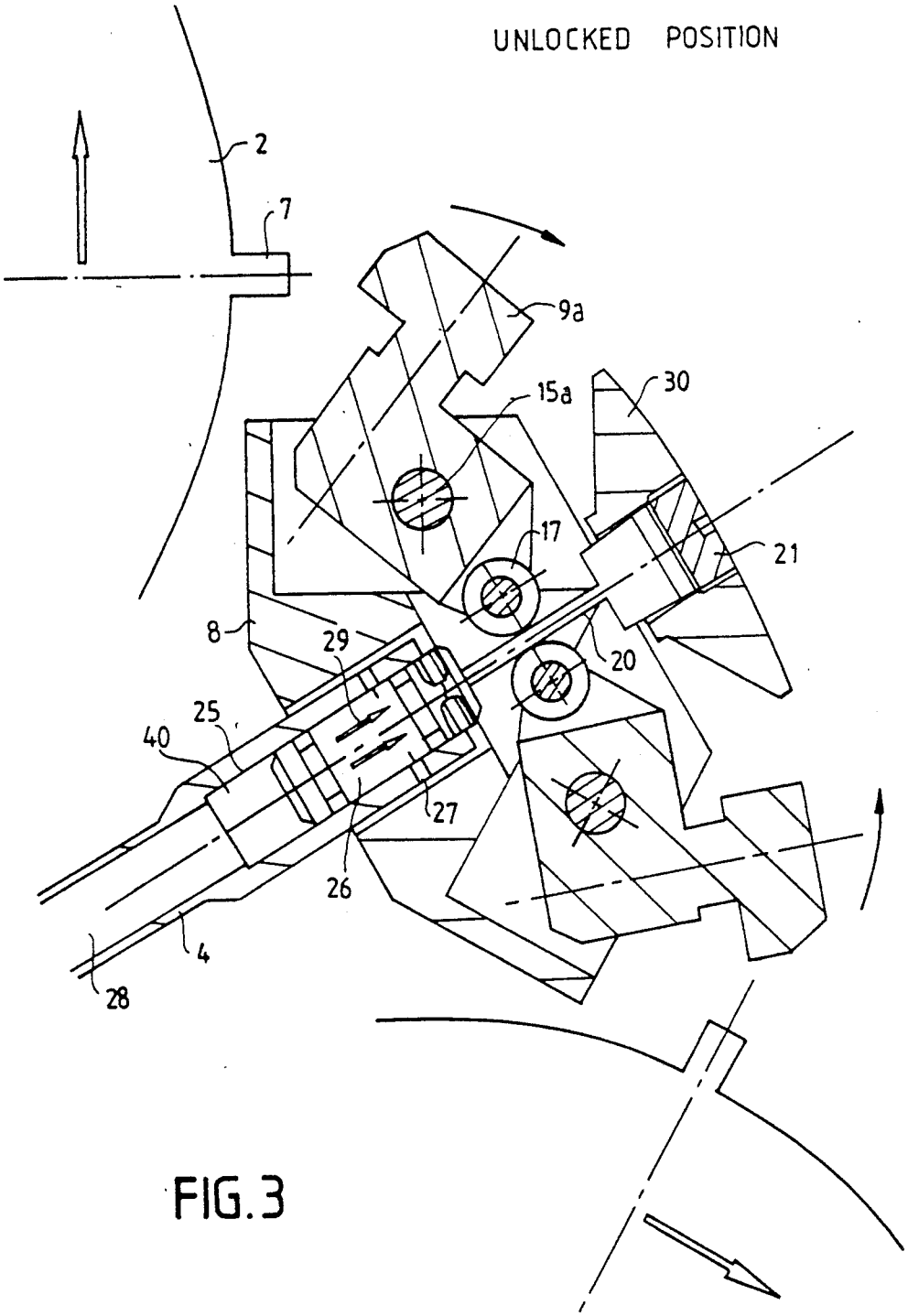
FIG. 3 shows a cross-section of a pneumatic unlocking device, according to the invention, for a sub-munitions fixing system in unlocked position.

FIG. 3 represents a cross-section of a pneumatic unlocking device for a fixing system according to the invention in unlocked position. The application of the ejection system provokes the simultaneous unlocking of the fixing systems holding the sub-munitions to the body of the carrier. After the actuation of the gas generator of the ejection system, at a pressure $P_1$ lower than the expansion pressure $P_2$ of the bags, the gases are sent towards the piston 26 which, under the pressure $P_1$, shears the shearing pin 27, thus driving the rod 20 in a translational motion (the movement is represented by the arrows 29). This rod 20 gets engaged in the cavity 19, provided to this effect, up to the closing cap 21 of this cavity 19. The roller 17 lying on the step part 18, the diameter and width of which, before the movement of the rod 20, prevents any motion of the holding clamp 9*a*, topples over on to the central part 22, the diameter and width of which permit the release of the fixing system through the rotation of the holding clamp 9*a* around the rotation shaft 15*a*. This roller 17 is made of steel for example. The holding clamp 9*a* then releases the external support 7 from the sub-munition, and does so on either side of the upper end of the body 1 of the carrier, thus allowing the sub-munitions on board the body 1 of the carrier to escape.

Figure 4:
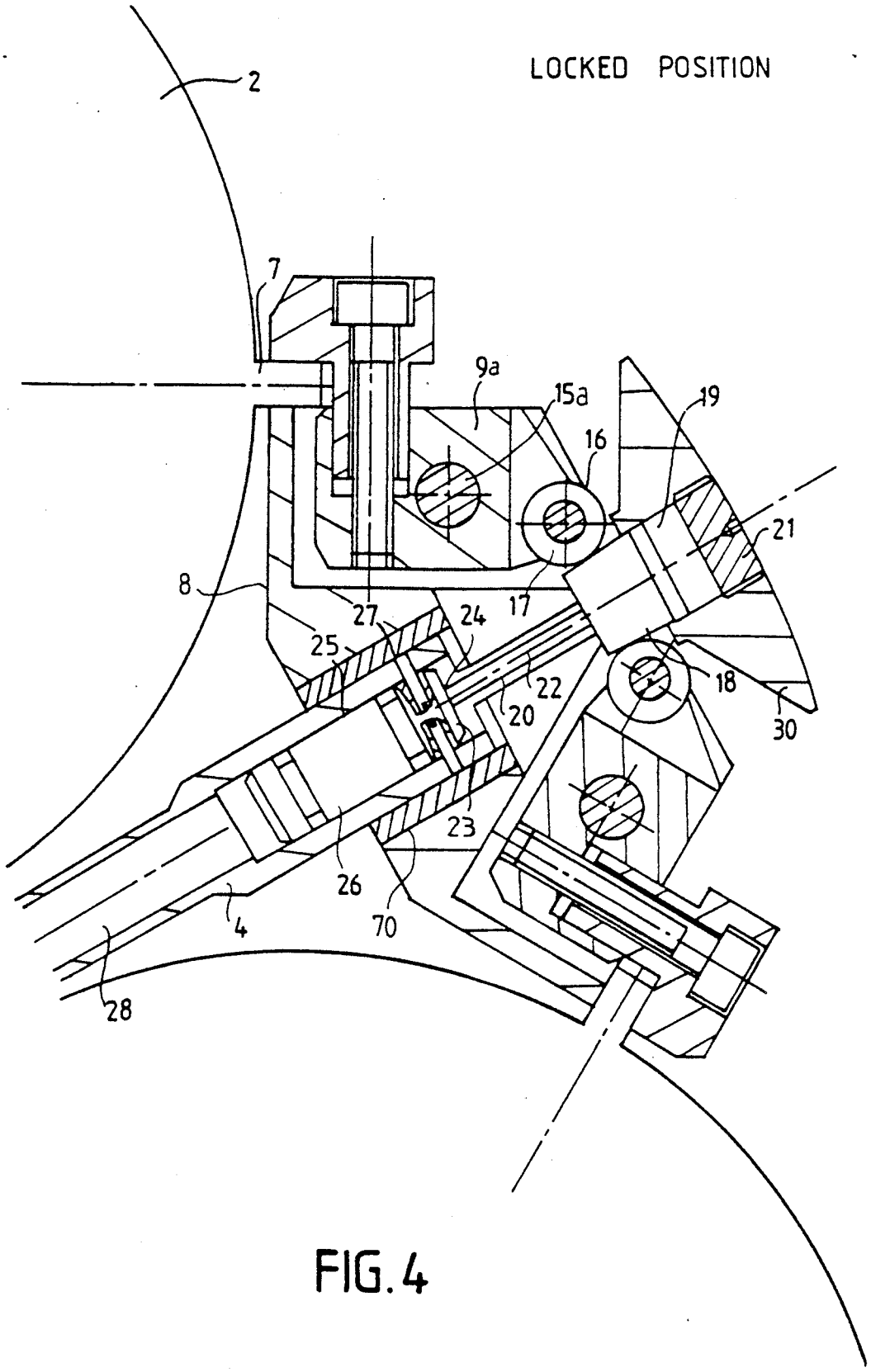
FIG. 4 shows the pneumatic unlocking device of the present invention having a damping system.

To restrict the transmission of vibrations between the sub-munitions and the structure of the carrier, a system of dampers acting as an uncoupling system may be placed in the embodiment as shown in FIG. 4. For, it suffices to replace the fixed part 8, made of steel for example, connected to the edge 4 of the structure of the carrier, by a damper system 70 that absorbs the different vibrations liable to be transmitted and thus prevents possible damage to the sub-munition. The fixed part 8 which is made of steel is not directly connected to the edge shown in FIGS. 2 and 3. In FIG. 4, the damper system 70 separates the fixed part 8 from the edge 4 and thus absorbs the vibrations coming from the carrier.

This pneumatic unlocking device for sub-munitions can be applied more particularly to sensitive sub-munitions, namely to any type of projectile used in a harsh environment where major precautions have to be taken to prevent a transfer of vibrations causing damage or a activation of the brittle parts of the sub-munition. This device according to the invention can be applied to any kind of system using a fixing device adapted to the properties of the system according to the invention.

What is claimed is:

1. A device for the unlocking of a fixing system holding sub-munitions on board a carrier, said sub-munitions comprising supports, said fixing system comprising a movable holding clamp rotatable around a shaft fixed in relation with edges of said carrier, said carrier comprising a gas generator and several compartments, each of said compartments comprising one sub-munition, said compartment being delimited by said edges, each of said edges including a conduit connected to the gas generator and an upper end comprising a cavity, said device comprising:

a piston positioned in the conduit connected to said gas generator;

a rod comprising a first part connected to a second step part which is wider than the first part, the first part being supported by the piston and the second step part being lightly engaged in the cavity;

wherein an end of the holding clamp comes into bearing against the step part of the rod, and wherein the gases of the gas generator produce a pressure which acts on the piston, the piston has a translational motion which drives the rod, the second step part gets engaged completely in the cavity enabling the end of the holding clamp to be supported by the first part, the translational motion allowing the rotation of the holding claim around the shaft.

2. A device for the unlocking of a fixing system according to claim 1, wherein the first part is joined to the piston by a flat part.

3. A device for the unlocking of a fixing system according to claim 1, wherein the end of the holding clamp comprises a roller which comes into bearing against the step part of the rod before the gases of the gas generator produce said pressure.

4. A device for the unlocking of a fixing system according to claim 1, wherein the piston comprises a shearing pin which locks the piston in the conduit before the gases of the gas generator produce said pressure.

* * * * *